US010986871B2

(12) United States Patent
Kennedy et al.

(10) Patent No.: US 10,986,871 B2
(45) Date of Patent: Apr. 27, 2021

(54) ELECTRONIC VAPORIZER AND SEALED CAPSULE

(71) Applicants: Mickey M. Kennedy, Medina, OH (US); Jerry Donovan Luccioni, Media, OH (US); Jason Alan Scott, Avon, OH (US)

(72) Inventors: Mickey M. Kennedy, Medina, OH (US); Jerry Donovan Luccioni, Media, OH (US); Jason Alan Scott, Avon, OH (US)

( * ) Notice: Subject to any disclaimer, the term of this patent is extended or adjusted under 35 U.S.C. 154(b) by 26 days.

(21) Appl. No.: 15/731,808

(22) Filed: Aug. 4, 2017

(65) Prior Publication Data

US 2019/0037921 A1 Feb. 7, 2019

(51) Int. Cl.

| | |
|---|---|
| ***A24F 40/00*** | (2020.01) |
| ***A24F 47/00*** | (2020.01) |
| ***H05B 1/02*** | (2006.01) |
| ***A24B 15/167*** | (2020.01) |
| ***A24F 40/10*** | (2020.01) |
| ***A24F 40/40*** | (2020.01) |
| ***A24F 40/42*** | (2020.01) |
| ***A24F 40/44*** | (2020.01) |

(52) U.S. Cl.

CPC ..... *A24F 47/008* (2013.01); *A24B 15/167* (2016.11); *A24F 40/10* (2020.01); *A24F 40/40* (2020.01); *A24F 40/42* (2020.01); *A24F 40/44* (2020.01); *H05B 1/0227* (2013.01); *H05B 1/0283* (2013.01)

(58) Field of Classification Search

USPC ..... 131/329

See application file for complete search history.

(56) References Cited

U.S. PATENT DOCUMENTS

| | | | | |
|---|---|---|---|---|
| 8,499,766 | B1 * | 8/2013 | Newton | A24F 47/002 131/273 |
| 2014/0014126 | A1 * | 1/2014 | Peleg | A24F 47/008 131/329 |

* cited by examiner

*Primary Examiner* — Michael J Felton

(74) *Attorney, Agent, or Firm* — Rankin, Hill & Clark LLP

(57) ABSTRACT

The disclosed subject matter relates to various components or elements of an electronic vaporizing device and related elements. For example, a sealed capsule that can mitigate escape of vaping contents included therein can be formed. Different sealed capsules can comprise different vaping contents having different types (e.g., liquids, plant materials, etc). The sealed capsule can be loaded into a heating chamber of the electronic vaporizing device in which the heating chamber can be configured specifically for the sealed capsules. As with the sealed capsule, there can be different types of vapor delivery portions of the device. The electronic vaporizing device can comprise a power source portion that can be configured to attach to many different types of vapor delivery portions.

14 Claims, 10 Drawing Sheets

ELECTRONIC VAPORIZER AND SEALED CAPSULE

TECHNICAL FIELD

The present application relates generally to an electronic and/or battery-powered vaporizer and a sealed capsule or pod configured for use with a suitably compatible vaporizer.

BACKGROUND

Many types of electronic vaporizers exist on the market, such as electronic cigarette vaporizers (AKA E-cigarettes vaporizers or E-cigarettes), which simulate the feeling of smoking, but without burning the tobacco or other contents. Thus, the E-cigarette does not generate smoke, but rather typically employs a heating element that atomizes a liquid solution or other contents to produce an aerosol or vapor. The user thus inhales this vapor rather than inhaling smoke. Such is commonly referred to as "vaping", which has certain advantages over smoking. For example, inhaling a vapor or aerosol (e.g., vaping) containing an active ingredient (e.g., nicotine) is believed to be a safer alternative to inhaling smoke. As another example, vaping can provide a more efficient delivery of the active ingredient to the user, since pyrolysis (or another type of thermochemical decomposition) can destroy a significant portion of the active ingredient.

Electronic vaporizers or "E-vapes" are typically designed to operate with specific types of materials. For example, some E-vapes are configured to operate with liquids or oils, which can contain the active ingredients. Other E-vapes are configured to operate with plant products. Still other E-vapes are configured to operate with other materials such as a wax or wax-like material containing the active ingredient.

BRIEF DESCRIPTION OF THE DRAWINGS

Numerous aspects, embodiments, objects and advantages of the present invention will be apparent upon consideration of the following detailed description, taken in conjunction with the accompanying drawings, in which like reference characters refer to like parts throughout, and in which.

DETAILED DESCRIPTION

Overview

Figure 1:
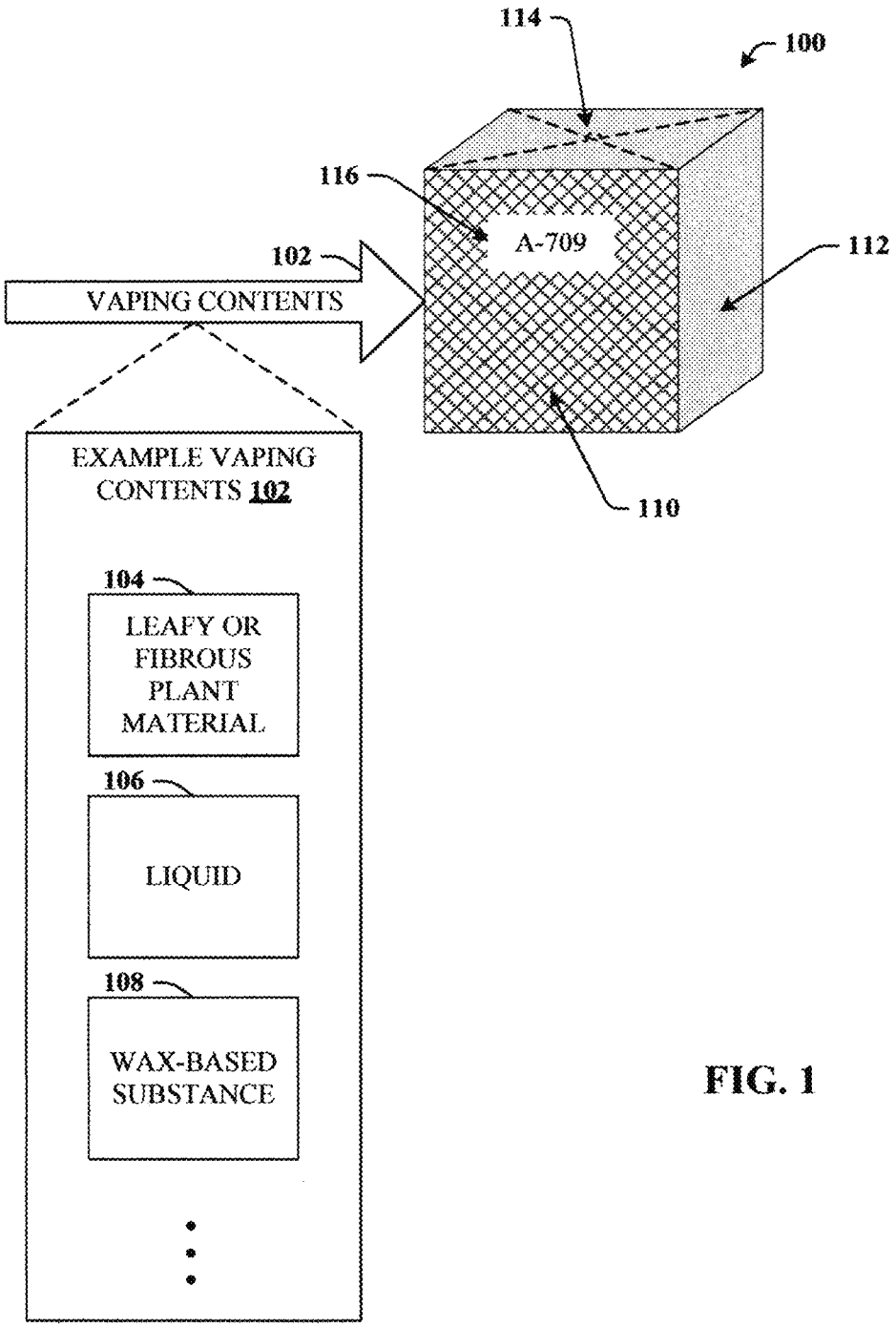
FIG. 1 illustrates a block diagram of an example sealed capsule in accordance with certain embodiments of this disclosure.

Vaping can provide certain advantages over smoking. For example, vaping can provide a more efficient delivery of an active ingredient (e.g., nicotine, cannabinoids, etc.). The active ingredient can typically be vaporized at a boiling point of the active ingredient. If this boiling point is less than activation of burning of the contents, more of the active ingredient can be released in the vapor and/or less of the active ingredient will be destroyed than when burning to produce smoke. Another potential advantage of vaping can be used in connection with reducing or quitting the use of a particular substance, since the dosage or concentration of an active ingredient can be gradually reduced or otherwise controlled. Still another potential benefit is that vaping is believed to be a less harmful alternative to inhaling smoke.

As noted in the Background section, electronic vaporizers are typically designed to operate with specific types of vaping contents in connection with delivery of the active ingredients. As used herein, "vaping contents" is intended to refer to the contents or materials that contain or convey the active ingredient(s) and are exposed to heating from a heating element of the host e-vape device. Such vaping contents can be liquids or oils, plant products, or a wax or wax-like material. However, a particular E-vape device is typically designed to operate with one, specific type of vaping contents. For example, an E-vape device designed to vaporize a plant product typically will not correctly operate with a liquid product used by different E-vape devices, and vice versa.

In some embodiments, the disclosed subject matter relates to an electronic vaporizer device that can support different types of vaping contents. Such can be accomplished in a variety of ways. For example, in some embodiments, the E-vape device can comprise a single base power unit (e.g., comprising the battery or other power source that powers the heating elements) and an interchangeable vapor delivery system portion (e.g., comprising the heating chamber where the vaping contents are exposed to the heating elements). Advantageously, a single power unit base can operate many different types of vapor delivery systems, such as a vapor delivery system that is specifically designed for liquid vaping contents, a second vapor delivery system that is specifically designed for plant material vaping contents, or others. Since different vaping contents can have different temperature requirements (e.g., to boil or vaporize the active ingredient without burning the vaping contents or active ingredient), in some embodiments, the vapor delivery system can determine the heat that will be produced by the heating elements. Such can be configurable or can be determined by the type of vaping contents for which the particular vapor delivery system is designed.

As another example of supporting different types of vaping contents, the disclosed subject matter further relates to a sealed capsule, which can also be referred to as a pod or sealed pod. This sealed capsule can comprise the vaping contents and can be configured to have specific dimensions to fit an associated vaping chamber. As the name implies, the sealed capsule can be sealed to prevent the vaping contents from escaping, or mitigate such to a substantial degree. In the case of a plant material type of vaping contents, the sealed capsule can be formed in a mesh arrangement or another suitable arrangement to prevent or mitigate the escape of plant material. In the case of a liquid type of vaping contents, the sealed capsule can be spill-proof, or in some embodiments, hermetically sealed.

In some embodiments, the sealed capsule can contain vaping contents representing a single-use. In some embodiments, the sealed capsule can contain vaping contents representing a single dose of the active ingredient, which can be determined according to a defined scale.

In some embodiments, the sealed capsule can be of a standardized size that is supported by the E-vape device. It is understood that the E-vape device can thus support substantially any type vaping contents (e.g., liquids, solids, fibrous plant material, etc.) by having a chamber that supports the sealed capsule. In some embodiments, the E-vape device can have a configurable or controllable heating element. Such can be employed to match the temperature produced by the heating element to the vaping contents. In some embodiments, the sealed capsule can include an indicator of a suggested setting for the E-vape device and/or the heating elements of the E-vape device.

Example Embodiments

Various aspects or features of this disclosure are described with reference to the drawings, wherein like reference numerals are used to refer to like elements throughout. In this specification, numerous specific details are set forth in order to provide a thorough understanding of this disclosure. It should be understood, however, that certain aspects of disclosure may be practiced without these specific details, or with other methods, components, materials, etc. In other instances, well-known structures and devices are shown in block diagram form to facilitate describing the subject disclosure.

Referring now to the drawing, with reference initially to FIG. 1, a block diagram of an example sealed capsule 100 is depicted. Sealed capsule 100 can comprise vaping contents 102. Examples of vaping contents 102 (e.g., that are included in sealed capsule 100) can be, for example, a leafy or fibrous plant material 104, a liquid 106, a wax-based substance 108, and any other suitable contents. An example of leafy or fibrous plant material 104 can be, e.g., material from a tobacco plant, material from a cannabis plant, and so forth that comprises an active ingredient (e.g., nicotine, a cannabinoid, etc.). An example of liquid 106 can be an oil or other solution comprising a particular active ingredient. An example of wax-based substance 108 can be substantially any waxy contents comprising the active ingredient.

In some embodiments, sealed capsule 100 can comprise a single use of vaping contents 102. In some embodiments, sealed capsule 100 can comprise a single dose of the active ingredient. The dosage can be determined according to any suitable standard or measure.

In some embodiments, sealed capsule 100 can be configured with an outer shell or housing that can mitigate escape of vaping contents 102. This housing can be arranged in a mesh configuration, as illustrated by reference numeral 110 (e.g., the forward-facing surface). In some cases the mesh can be a wire mesh, a string or strand mesh, a plastic mesh or another suitable type. In some cases, the wire mesh can comprise a metal such as copper, stainless steel, or another suitable material. In some embodiments, sealed capsule 100 can be configured with solid shell or housing, as illustrated by reference numeral 112 (e.g., the side-facing surface). Such can create a non-drip housing or in some cases a hermetically sealed housing in some embodiments. In some embodiments, the housing can comprise a high-temperature plastic, polymer, resin, or other suitable material.

In some embodiments, the type of housing of the sealed capsule can be based on the type of vaping contents 102. For example, leafy or fibrous plant material contents 104 can be used with mesh type housings 110. As another example, liquid contents 106 can be used with solid housings 112. It is appreciated that sealed capsule 100 can mitigate leaks or drips of liquid type vaping contents 102, which can be a significant advantage over conventional systems. For example, some conventional systems that use liquids will spill or leak if tilted or dropped.

In some embodiments, sealed capsule 100 can comprise a perforation region or perforations, as illustrated by reference numeral 114. Perforations 114 can be configured to be perforated by a heating element of an electronic vaporization device (see FIG. 7). Perforations 114 can be used in connection with liquid (e.g., liquid 106) vaping content 102.

In some embodiments, sealed capsule 100 can comprise an indicator element 116. Indicator element 116 can indicate a suggested temperature or range of temperatures. For example, indicator element 116 can suggest the temperature at which the active ingredient(s) of vaping contents 102 are determined to boil or vaporize or a target temperature for heating elements of an associated electronic vaporization device. As another example, indicator element 116 can indicate a type of vaping contents 102 (e.g., liquid, wax, plant material, etc), which can suggest ranges for the vaporization temperature or the heating element target temperature.

In some embodiments, indicator element 116 can be a visual indicator. For example, a product code or serial number can be printed on the housing of sealed capsule 100. Additionally or alternatively, indicator element 116 can represent an electronic indicator or other signaling mechanism that can pass information relating to suggested temperature settings or the like to the electronic vaporization device. One example of such can be a radio frequency identifier (RFID), such as an RFID dot, which can be passive or active. It is understood that other examples of indicator element 116 can exist. Substantially any mechanism that can indicate various temperature information and/or vaping contents type can be used, whether such information is intended for the user (e.g., a visual indicator) or to be automatically determined or detected by the electronic vaporization device.

Figure 2:
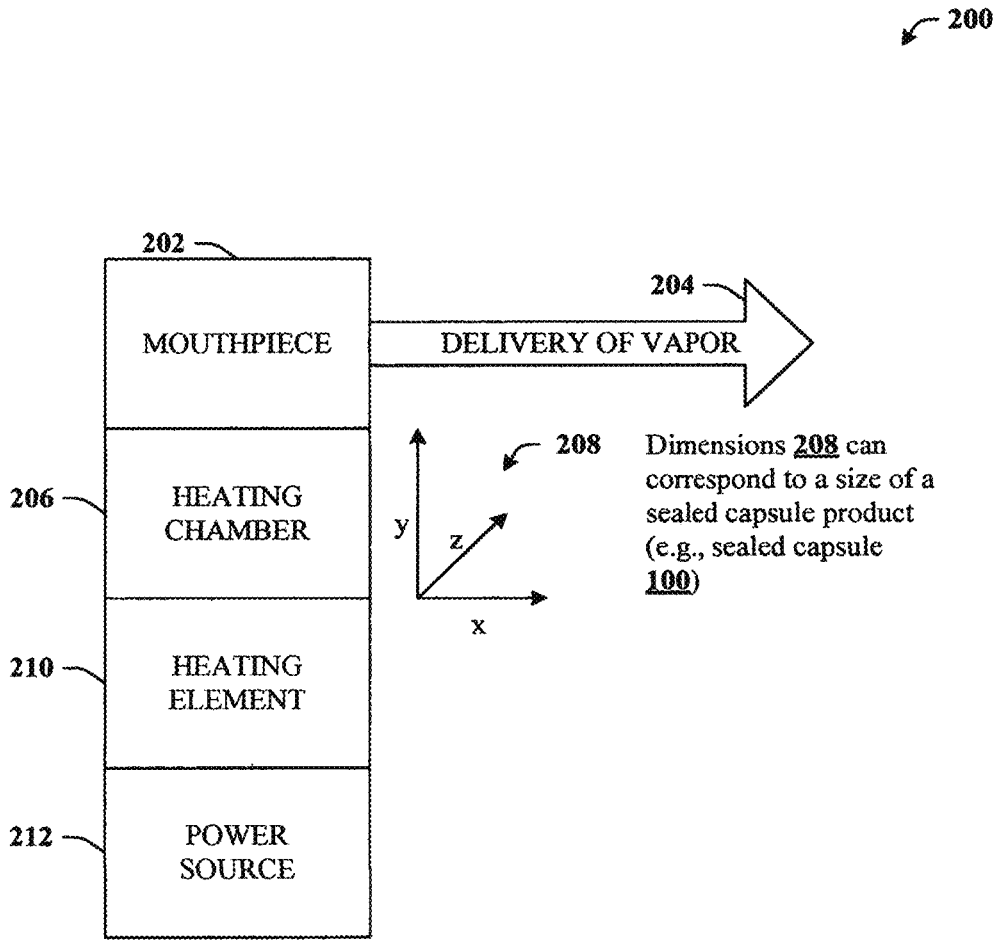
FIG. 2 illustrates a block diagram of an example electronic vaporization device in accordance with certain embodiments of this disclosure.

Turning now to FIG. 2, a block diagram of an example electronic vaporization device 200 is depicted. Electronic vaporization device 200 can comprise a mouthpiece 202 that can be configured to facilitate delivery of a vapor, illustrated by reference numeral 204. For example, when a user inhales, mouthpiece 202 can deliver vapor to the user.

Electronic vaporization device 200 can further include heating chamber 206. Heating chamber 206 can be coupled to mouthpiece 202 in a suitable manner. For example, to allow vapor produced in heating chamber 206 to pass to mouthpiece 202 for subsequent delivery 204 to the user. Heating chamber 206 can have defined dimensions 208 (e.g., x-axis, y-axis, or z-axis distances) that correspond to a size of a sealed capsule product (e.g., sealed capsule 100) that comprises vaping contents (e.g., vaping contents 102).

For instance, defined dimensions 208 can be configured to match or be suitable for the size and shape of sealed capsule 100.

Electronic vaporization device 200 can further comprise one or more heating element(s) 210 and power source 212. The heating element(s) 210 can be configured to vaporize at least a portion of the vaping contents, such as the active ingredient included in the vaping contents. The power source 212 can be configured to supply power to the heating element.

In some embodiments, heating element(s) 210 can be coupled to heating chamber 206. Such embodiments can be useful for plant material contents (e.g., see FIG. 6) or wax-based substance contents (e.g., see FIG. 8).

In some embodiments, heating chamber 206 can be configured to receive the heating element(s) 210 and heating element(s) 210 can be configured to be inserted into the heating chamber 206 and removed from the heating chamber 206. Such embodiments can be useful for liquid contents (e.g., see FIG. 7). For instance, heating element(s) 210 can puncture (e.g., at perforation 114) sealed capsule 100 to have direct contact with the vaping content 102 contained in sealed capsule 100.

In some embodiments, heating chamber 206 is configured to receive the sealed capsule product (e.g., sealed capsule 100) in response to an opening operation. The opening operation can represent substantially any operation in which the chamber can be exposed and/or the sealed capsule product can be inserted. For example, heating chamber 206 can detach from mouthpiece 202 in some suitable manner, such as unscrewing, unclipping, ejecting, etc. Thereafter, in some embodiments, the heating element(s) 210 can be configured to penetrate the sealed capsule product in response to a closing operation.

In embodiments in which the vaping contents 102 are in a liquid 106 state, electronic vaporization device 200 can further comprise wicking elements. Such wicking elements can be coupled to the heating element(s) 210, and can facilitating wicking of the vaping contents toward the heating element(s) 210.

In some embodiments, electronic vaporization device can be configured to mitigate leaking or escape of the vaping contents 102 in response to the closing operation. For example, the closing operation, in which the heating element(s) 210 can penetrate the sealed capsule product, can continue to prevent leaking or spills even while the vapor can be passed to mouthpiece 202 for delivery 204 of the vapor.

Figure 3:
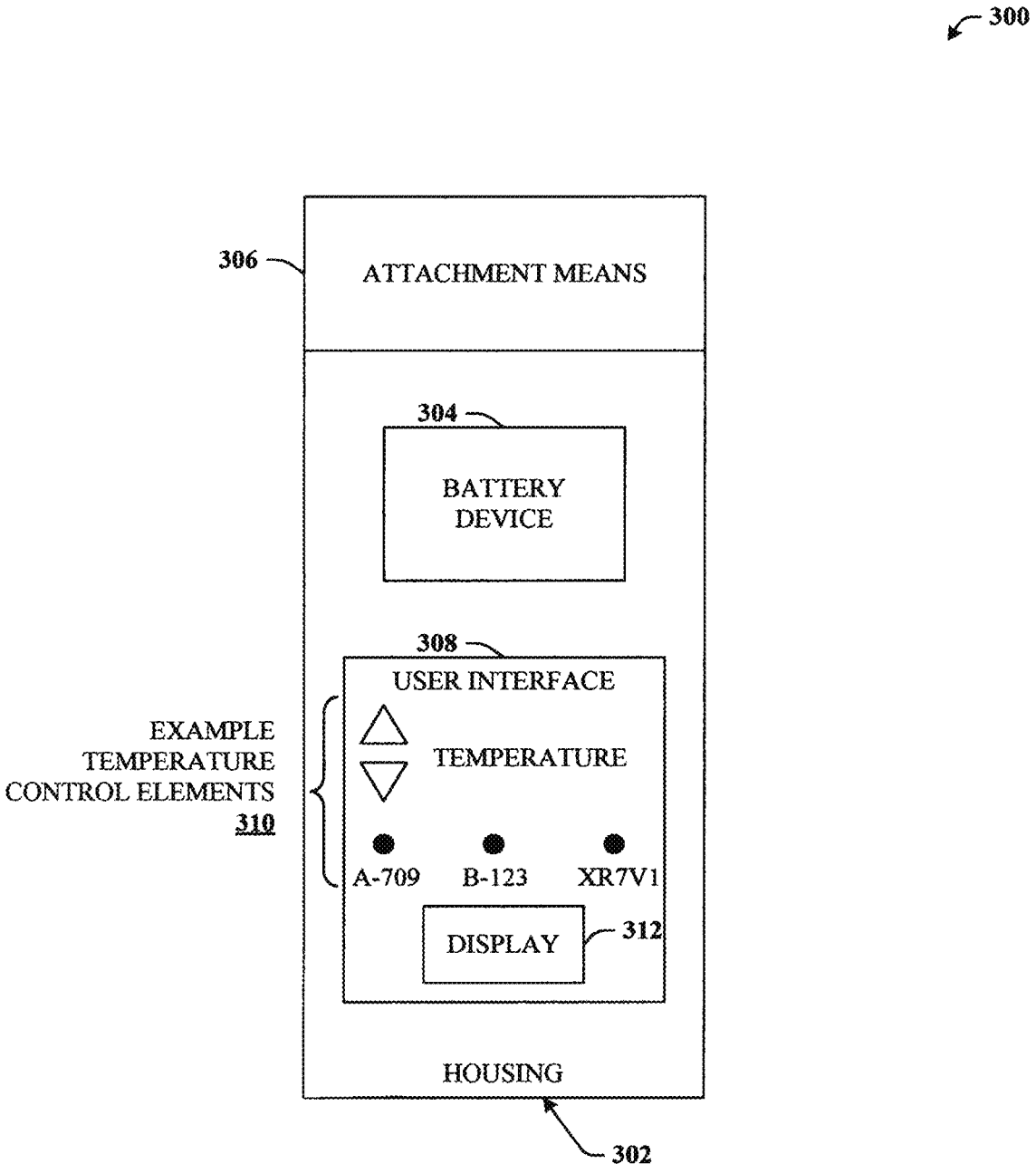
FIG. 3 illustrates a block diagram of a power source device of an electronic vaporization device in accordance with certain embodiments of this disclosure.

Referring now to FIG. 3, a block diagram of a power source device 300 of an electronic vaporization device is depicted. For example, power source device 300 can be representative of power source 212 of FIG. 2. Power source device 300 can comprise a housing 302 and a battery device 304 that can be coupled to or included in housing 302. Battery device 304 can, e.g., store charge and can be configured to power a heating element (e.g., heating element(s) 210) of the electronic vaporization device (e.g., electronic vaporization device 200). Battery device 304 can be rechargeable or interchangeable. In some embodiments, battery device 304 can be recharged via a plug adapter (not shown) of any suitable variety, including universal serial bus (USB).

In some embodiments, power source device 300 can comprise attachment means 306. Attachment means 306 can be coupled to or included in housing 302. Attachment means 306 can be configured to detachably attach to multiple different types of vapor delivery devices of an electronic vaporization device. Using electronic vaporization device 200 as a representative example, mouthpiece 202, heating chamber 206, and/or heating element(s) 210 can represent the vapor delivery device that can be interchangeable attached to power source 212 (and wherein power source 212 can be a representative example of power source device 300). It is understood that attachment means 306 can represent any suitable means or mechanism for attaching the power source device to the vapor delivery device components. Examples include mated threading means or mechanisms, one of a male or female plug element or mechanism, a slotted clipping means or mechanism, a magnet or magnetized means or mechanisms and so forth.

In some embodiments, power source device 300 can comprise a user interface 308. User interface 308 can comprise, e.g., any suitable combination of user interface elements, such as input elements (e.g., buttons, knobs, switches, etc.) and output elements (e.g., visual displays, audio presentations, or other types of presentation elements). For example, user interface 308 can include temperature control elements 310 that can be operatively coupled to battery device 304. Temperature control elements 310 can adjustably control a temperature of a heating element (e.g., 210), e.g., to facilitate vaporization of the active ingredient(s) and/or other portions of the vaping contents. Given that electronic vaporizing devices (e.g., 200) detailed herein can operate with a wide array of differing types of vaping contents, which can have different temperature requirements, it can be beneficial to be able to adjust the output of the heating element and, by proxy, the temperature in the heating chamber to which the vaping contents are exposed.

In that regard, temperature control elements 310 can comprise buttons or other tactile-based input elements to allow the user to manually adjust the temperature, either increasing or decreasing the temperature. In some embodiments, temperature control elements 310 can comprise multiple different temperature settings that correspond to multiple different types of vaping contents. One example of such is the buttons with labels corresponding to various product codes (or other indicator elements 116). For instance, power source device 300 can determine the temperature of the heating element in response to selection or other input that indicates the type of vaping contents or the type of sealed capsule product, which can be input via temperature control elements 310. In some embodiments, input of the type of vaping contents (e.g., liquid, plant material, etc.) can result in a determined range of temperatures. For example, the range of temperature can be higher for liquid contents types than for plant material contents types, but the temperature within those ranges can be adjustably controlled by temperature control elements 310.

In some embodiments, power source device 300 can determine the temperature of the heating element in response to a determination of a type of the vapor delivery device that is attached to attachment means 306. Thus, it should be understood that the temperature of the heating elements can be determined in a variety of ways, which can be both manually determined or automatically determined by components or circuitry of power source device 300. For example, a user may manually input, via temperature control elements 310, a temperature (e.g., 500 degrees) or manually select a temperature or range of temperatures by selecting a setting (e.g., A-709) representative of a type of vaping contents or a type of sealed capsule product. Such information can be learned by the user based on information included with the sealed capsule (e.g., indicator element 116).

Additionally or alternatively, the information utilized to determine the temperature or temperature ranges can be automatically received. For example, power source device 300 can electronically received such information in response to a signal from an RFID dot or other suitable indicator element 116 of the sealed capsule product. As another example, power source device 300 can determine the temperature or temperature ranges based on the type of vapor delivery device to which it is attached (e.g., via attachment means 306). For instance if power source device 300 is attached to a vapor delivery device specifically tailored for liquid content types, then suitable temperatures or ranges can be identified for that type and so on. Power source device 300 can acquire the vapor delivery device in response to attaching to that device, which can include an identifier of the type that can be read upon attaching.

Example Methods

Figure 4:
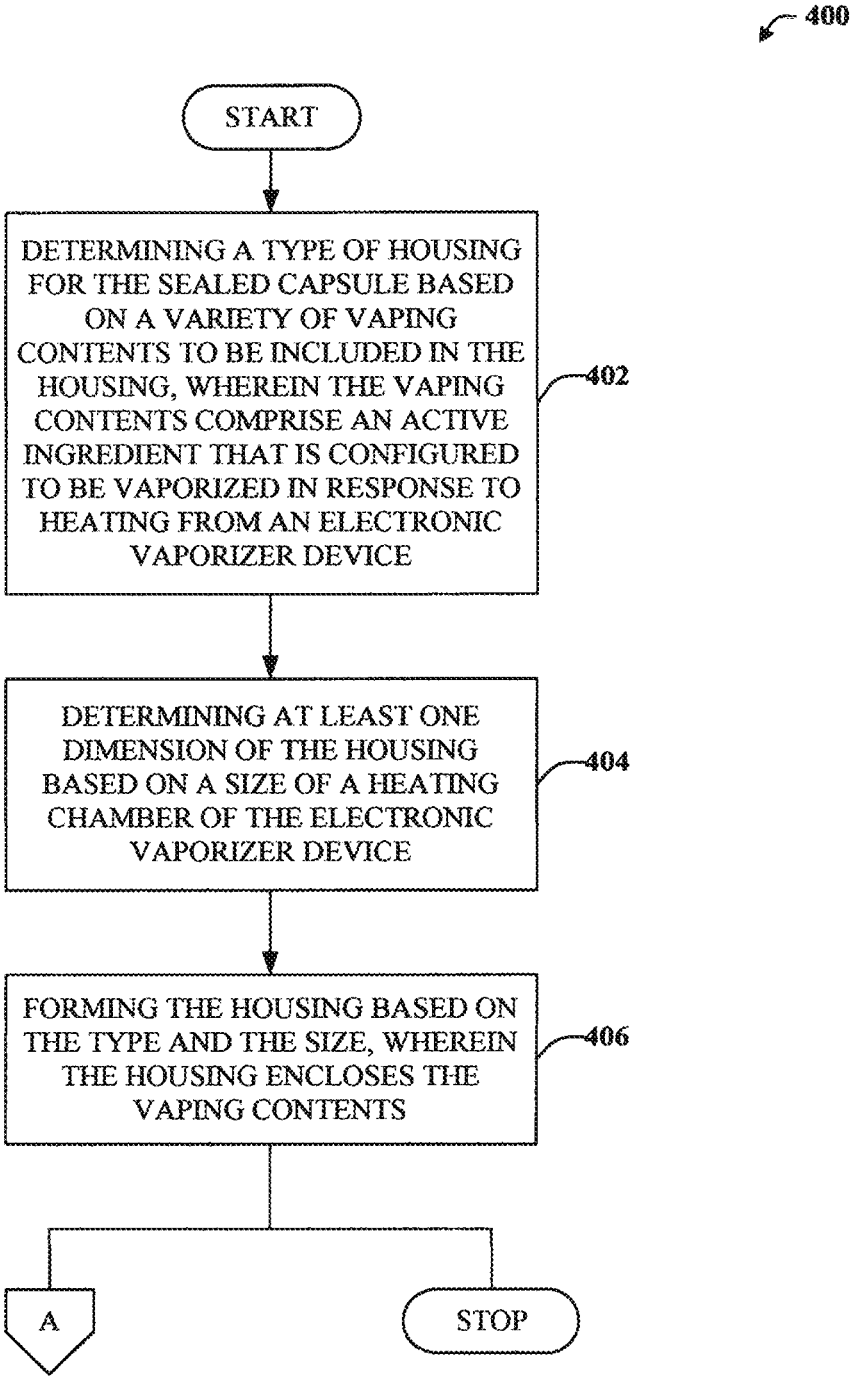
FIG. 4 illustrates an example methodology that can provide for constructing a sealed capsule in accordance with certain embodiments of this disclosure.
Figure 5:
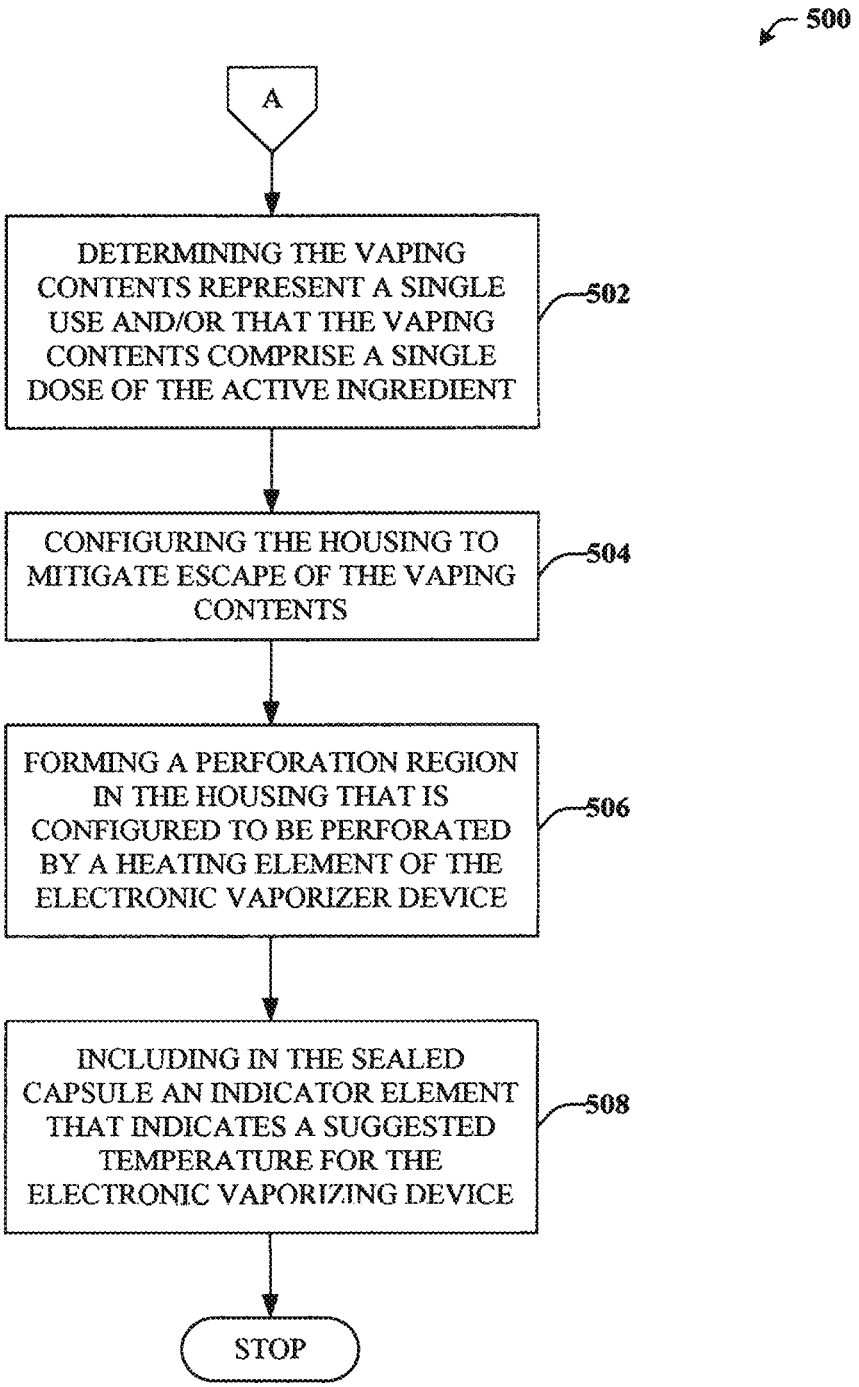
FIG. 5 illustrates an example methodology that can provide for additional aspects or elements in connection with constructing the sealed capsule in accordance with certain embodiments of this disclosure.

FIGS. 4 and 5 illustrate methodologies in accordance with the disclosed subject matter. While, for purposes of simplicity of explanation, methodologies are shown and described as a series of acts, it is to be understood and appreciated that the disclosed subject matter is not limited by the order of acts, as some acts may occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the disclosed subject matter. Additionally, it should be further appreciated that the methodologies disclosed hereinafter and throughout this specification are capable of being stored on an article of manufacture to facilitate transporting and transferring such methodologies to computers.

Turning now to FIG. 4, example method 400 is depicted. Method 400 can provide for constructing a sealed capsule. For example, at reference numeral 402, a type of housing for the sealed capsule can be determined. Such a determination can be based on a variety of vaping contents to be included in the housing. For example, the vaping contents can be of a plant product variety (e.g., comprising a fibrous or leafy plant material). As another example, the vaping contents can be of a liquid variety. These and other example varieties of vaping contents can result in different types of housings. For instance, it is understood that the vaping contents can comprise an active ingredient that is configured to be vaporized in response to heating from an electronic vaporizer device. Different vaping contents and/or active ingredients can lead to differing needs or advantageous in connection with the type of housing selected, be it heating parameters, mitigation of vaping contents escape, or the like. Hence, the type of housing can be specifically selected based on the type of vaping contents to be used.

At reference numeral 404, at least one dimension (e.g., height, width, thickness, etc.) of the housing can be determined. Such dimension(s) can be determined based on a size of a heating chamber of the electronic vaporizer device.

At reference numeral 406, the housing can be formed based on the type of vaping contents (e.g., determined at reference numeral 402) and the size of the heating chamber (e.g., detailed in connection with reference numeral 404). It is understood that the housing can be formed to enclose the vaping contents. Method 400 can end or proceed to Tab A, which is further detailed in connection with FIG. 5.

Turning now to FIG. 5, method is depicted. Method 500 can provide for additional aspects or elements in connection with constructing the sealed capsule. For example, at reference numeral 502, the vaping contents can be determined to comprise a single use. For example, an amount of vaping contents can be determined to be sufficient for a single use. In some embodiments, the vaping contents can be determined to comprise a single dose of the active ingredient. For example, it can be determined that the amount of active ingredient within the vaping contents or that is estimated or determined to be adequately vaporized during use can be sufficient to represent a single dose. Dosage determinations can be based on any suitable schedule, scale, or other data.

At reference numeral 504, the housing (e.g., formed at reference numeral 406) can be configured to mitigate escape of the vaping contents. For example, in the case of plant material contents, the housing can be arranged as a webbing or mesh structure. In the case of liquid vaping contents, the housing can be configured as a solid structure that can be substantially leak-proof, hermetically sealed, or the like.

At reference numeral 506, a perforation region can be formed in the housing. The perforation region can be configured to be perforated by a heating element of the electronic vaporizer device. Thus, the heating element can be inserted inside the sealed capsule, which can allow vapor to be delivered, while still substantially maintaining the non-drip features and/or while still mitigating escape of the vaping contents.

At reference numeral 508, an indicator element can be included in the sealed capsule. The indicator element can indicate a suggested temperature for the electronic vaporizing device. In some embodiments, the indicator element can indicate a type of the sealed capsule or a type of the contents included in the sealed capsule. Such can be employed to determine the suggested temperature. In some embodiments, the indicator element can be a visual element such as alphanumeric symbols or other symbols that indicate the temperature or the type, such as a product code or the like. In some embodiments, the indicator element can broadcast (potentially passively or in response to a signal) the temperature or type information, such as via an RFID element.

Example Design Elements

Figure 6:
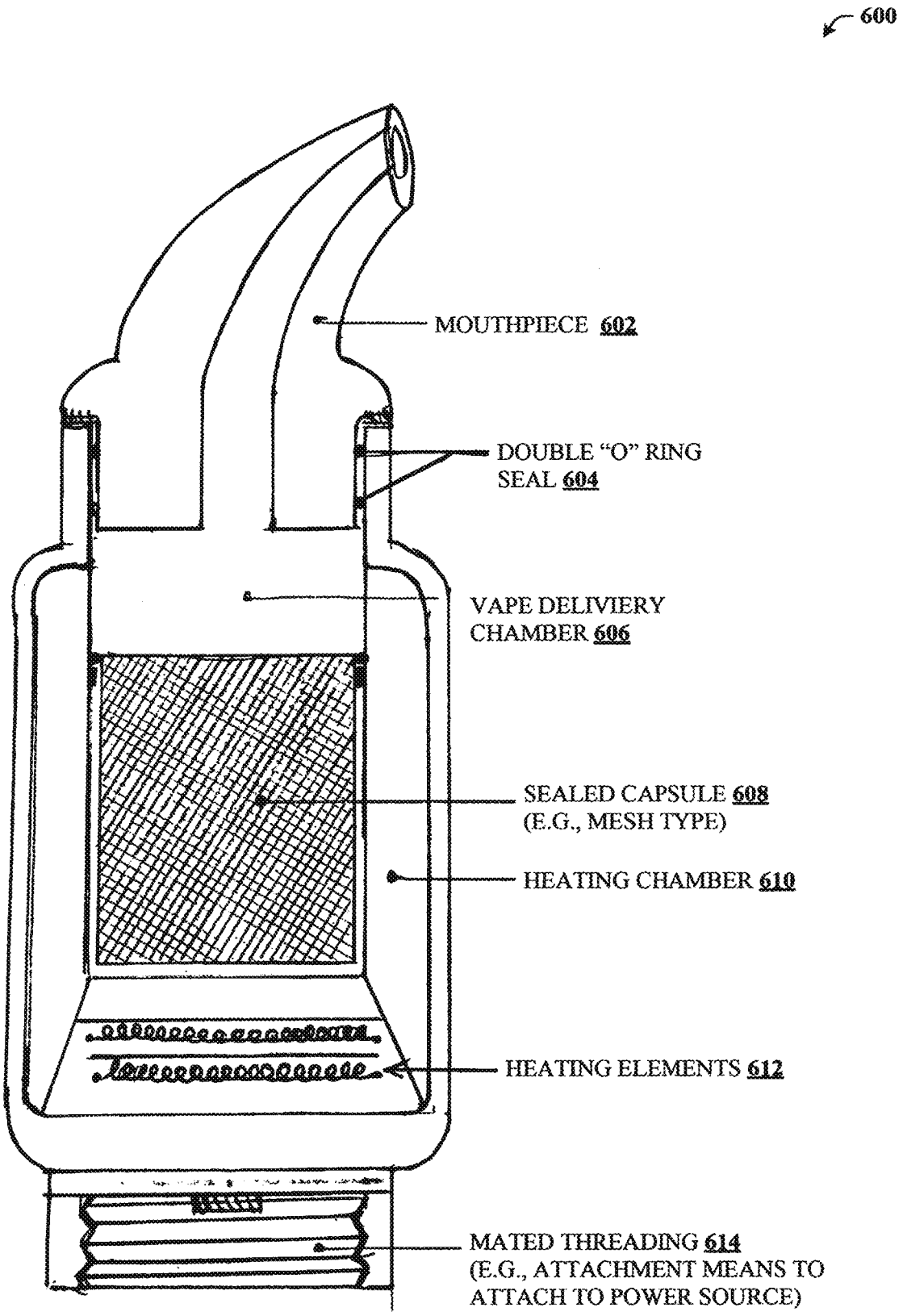
FIG. 6 depicts an illustration of a first example vapor delivery device suitable for use with plant material type contents in accordance with certain embodiments of this disclosure.

With reference now to FIG. 6, illustration 600 is provided. Illustration 600 depicts a first example vapor delivery device suitable for use with plant material type contents. The vapor delivery device can comprise mouthpiece 602, a double "O" ring seal 604, and a vape delivery chamber 606. As depicted, a heating chamber 610 or the vapor delivery device is loaded with a sealed capsule 608, which can represent a mesh-type sealed capsule 100 with leafy or fibrous plant material 104 as the vaping contents 102. In this example, heating elements 612 are below the heating chamber 610, but can be in any suitable location in other embodiments. The vapor delivery device can further comprise a complementary attachment means configured to attach to a power source device. In this example, the complementary attachment means is depicted as mated threading 614, but other means are suitable.

Figure 7:
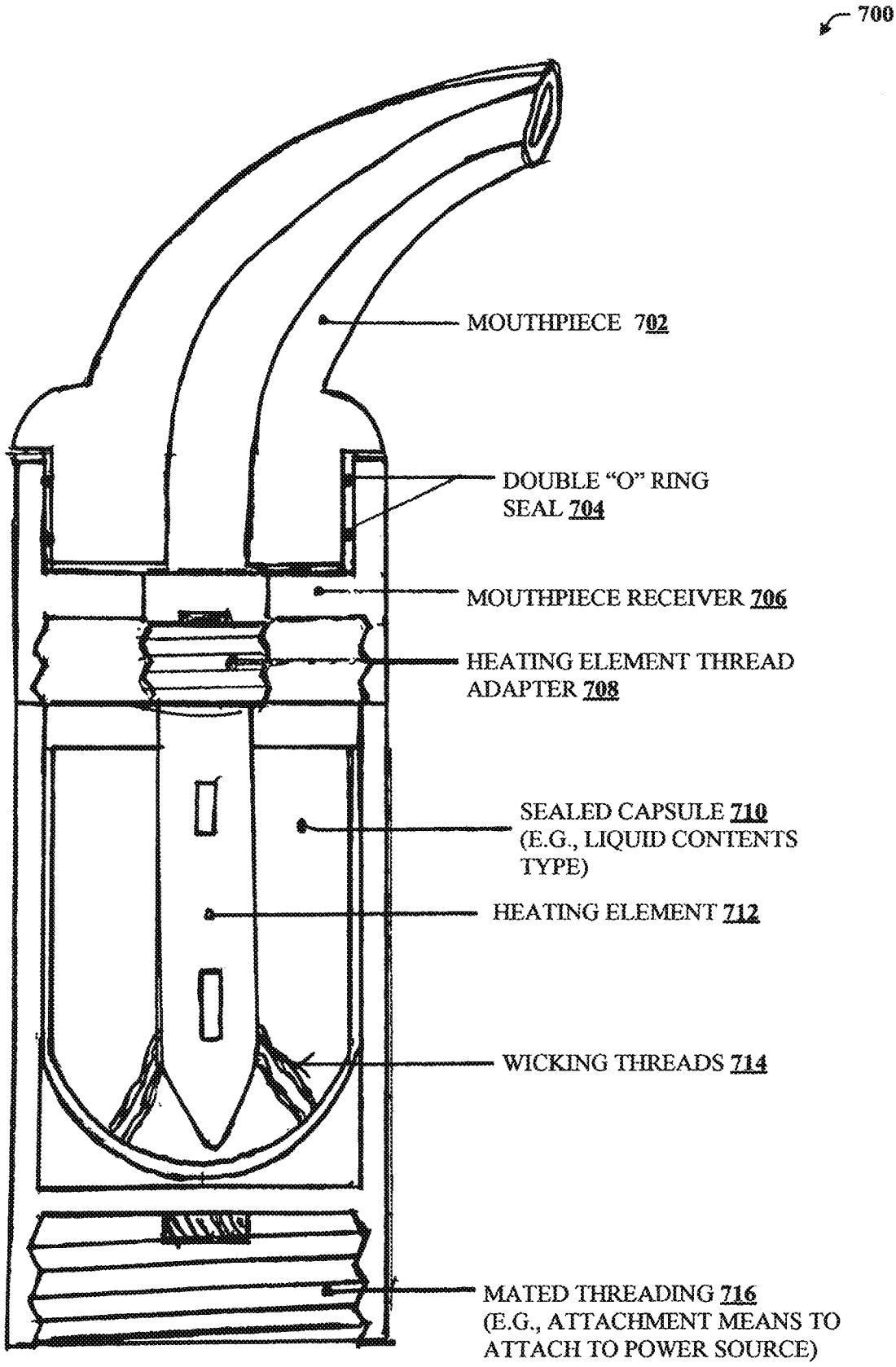
FIG. 7 depicts an illustration of a second example vapor delivery device suitable for use with liquid type contents in accordance with certain embodiments of this disclosure.

Turning now to FIG. 7, illustration 700 is provided. Illustration 700 depicts a second example vapor delivery device suitable for use with liquid type contents. The vapor delivery device can comprise mouthpiece 702, a double "O" ring seal 704, a mouthpiece receiver element 706, and a heating element thread adapter 708. The heating element thread adapter (as well as any other suitable attachment means) can facilitate secure penetration of heating element 712 into sealed capsule 710. Sealed capsule 710 can represent a solid housing type sealed capsule 100 with liquid 106 as the vaping contents 102. In some embodiments, the vapor delivery device can comprise wicking threads 714, as detailed herein. Once more, in this example, the complementary attachment means is depicted as mated threading 716, but other means are suitable.

Figure 8:
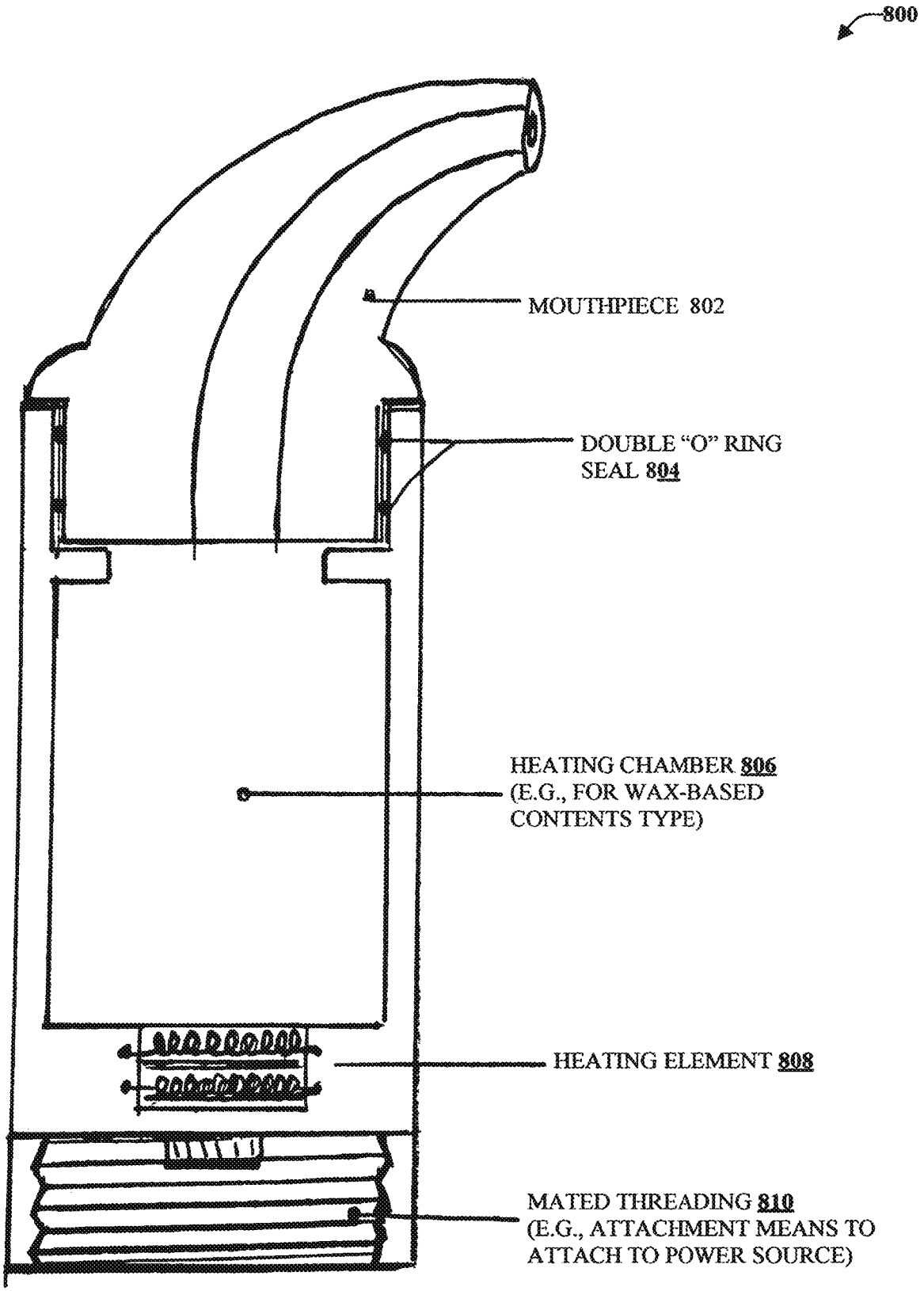
FIG. 8 depicts an illustration of a third example vapor delivery device suitable for use with waxy or wax-based contents in accordance with certain embodiments of this disclosure.

Referring now to FIG. 8, illustration 800 is provided. Illustration 800 depicts a third example vapor delivery device suitable for use with waxy or wax-based contents. The vapor delivery device can comprise mouthpiece 802, a double "O" ring seal 804, and heating chamber 806. In this embodiment, heating chamber 806 is not loaded with a sealed capsule. Rather, the wax-based contents can be placed into heating chamber 806 directly or alternatively enclosed in a sealed capsule (e.g., of the wax-based type 108). In this example, heating elements 808 are below the heating chamber 806, but can be in any suitable location in other embodiments. The vapor delivery device can further comprise a complementary attachment means configured to attach to a power source device. In this example, the complementary attachment means is depicted as mated threading 810, but other means are suitable.

Figure 9:
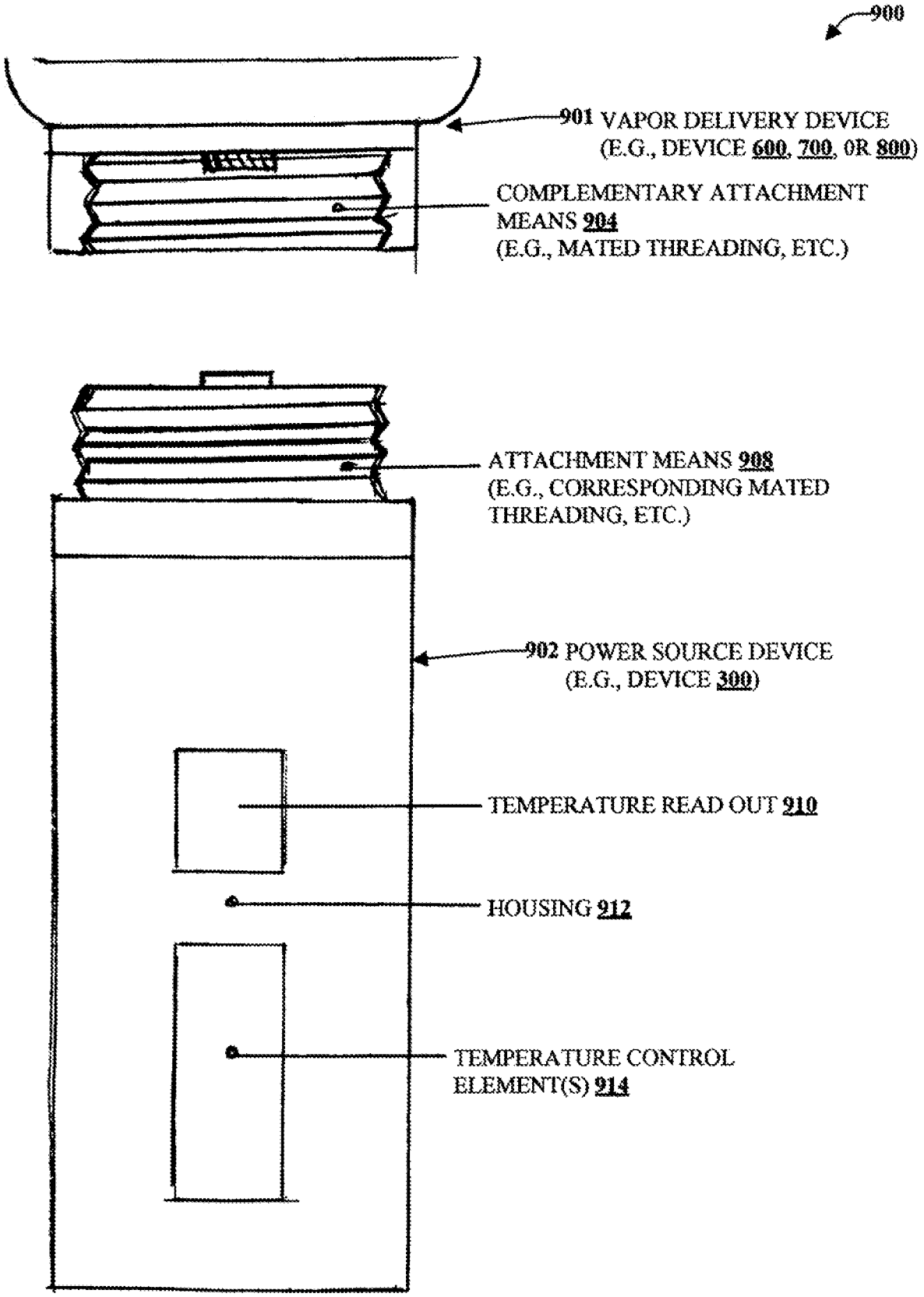
FIG. 9 depicts an illustration of an example a power source device that can interchangeably attach to different types of vapor delivery devices in accordance with certain embodiments of this disclosure.

Turning now to FIG. 9, illustration 900 is provided. Illustration 900 depicts a power source device that can interchangeably attach to different types of vapor delivery devices. For example, vapor delivery device 901 can be representative of a portion of any of vapor delivery devices 600, 700, 800, or any other suitable vapor delivery device. Vapor delivery device 901 can comprise complementary attachment means 904 that is configured to attach to attachment means 908. In this example, the attachment means 908 and the complementary attachment means 904 are mated threading, but other means can be suitable.

Power source device 902 can be representative of power source device 300, and can comprise a temperature read out 910, housing 912, and temperature control element(s) 914.

Example Computing Elements

The systems and processes described below can be embodied within hardware, such as a single integrated circuit (IC) chip, multiple ICs, an application specific integrated circuit (ASIC), or the like. Further, the order in which some or all of the process blocks appear in each process should not be deemed limiting. Rather, it should be understood that some of the process blocks can be executed in a variety of orders, not all of which may be explicitly illustrated herein.

Figure 10:
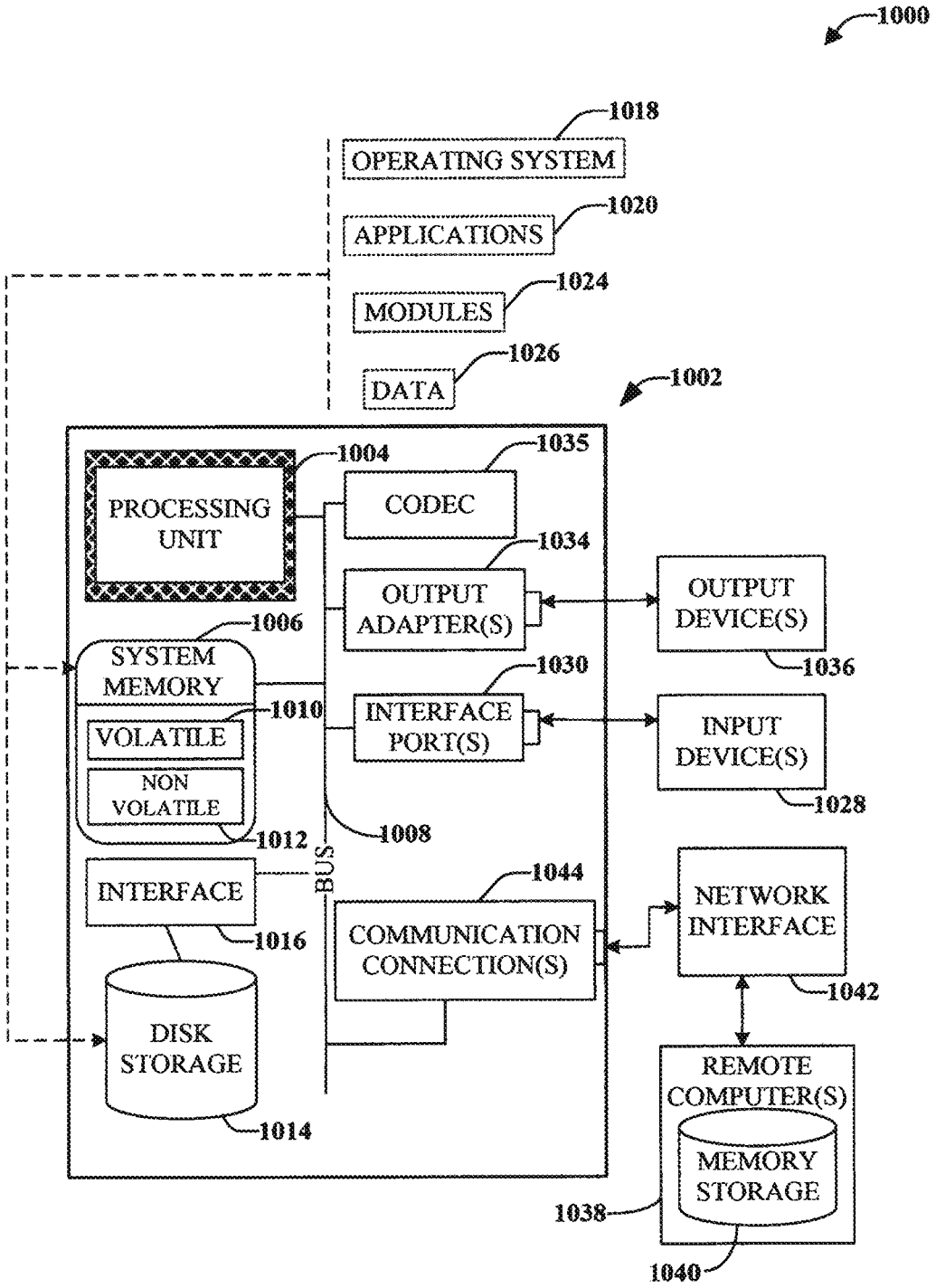
FIG. 10 illustrates an example schematic block diagram for a computing environment in accordance with certain embodiments of this disclosure.

With reference to FIG. 10, a suitable environment 1000 for implementing various aspects of the claimed subject matter includes a computer 1002. The computer 1002 includes a processing unit 1004, a system memory 1006, a codec 1035, and a system bus 1008. The system bus 1008 couples system components including, but not limited to, the system memory 1006 to the processing unit 1004. The processing unit 1004 can be any of various available processors. Dual microprocessors and other multiprocessor architectures also can be employed as the processing unit 1004.

The system bus 1008 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), and Small Computer Systems Interface (SCSI) or others now in existence or later developed.

The system memory 1006 includes volatile memory 1010 and non-volatile memory 1012. The basic input/output system (BIOS), containing the basic routines to transfer information between elements within the computer 1002, such as during start-up, is stored in non-volatile memory 1012. In addition, according to present innovations, codec 1035 may include at least one of an encoder or decoder, wherein the at least one of an encoder or decoder may consist of hardware, software, or a combination of hardware and software. Although, codec 1035 is depicted as a separate component, codec 1035 may be contained within non-volatile memory 1012 or included in other components detailed herein. By way of illustration, and not limitation, non-volatile memory 1012 can include read only memory (ROM), programmable ROM (PROM), electrically programmable ROM (EPROM), electrically erasable programmable ROM (EEPROM), or flash memory. Volatile memory 1010 includes random access memory (RAM), which acts as external cache memory. According to present aspects, the volatile memory may store the write operation retry logic (not shown in FIG. 10) and the like. By way of illustration and not limitation, RAM is available in many forms such as static RAM (SRAM), dynamic RAM (DRAM), synchronous DRAM (SDRAM), double data rate SDRAM (DDR SDRAM), and enhanced SDRAM (ESDRAM), resistive RAM (RRAM), or others now in existence or later developed.

Computer 1002 may also include removable/non-removable, volatile/non-volatile computer storage medium. FIG. 10 illustrates, for example, disk storage 1014. Disk storage 1014 includes, but is not limited to, devices like a magnetic disk drive, solid state disk (SSD) floppy disk drive, tape drive, flash memory card, or memory stick. In addition, disk storage 1014 can include storage medium separately or in combination with other storage medium including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 1014 to the system bus 1008, a removable or non-removable interface is typically used, such as interface 1016. It is appreciated that storage devices 1014 can store information related to a user. Such information might be stored at or provided to a server or to an application running on a user device. In one embodiment, the user can be notified (e.g., by way of output device(s) 1036) of the types of information that are stored to disk storage 1014 and/or transmitted to the server or application. The user can be provided the opportunity to opt-in or opt-out of having such information collected and/or shared with the server or application (e.g., by way of input from input device(s) 1028).

It is to be appreciated that FIG. 10 describes software that acts as an intermediary between users and the basic computer resources described in the suitable operating environment 1000. Such software includes an operating system 1018. Operating system 1018, which can be stored on disk storage 1014, acts to control and allocate resources of the computer system 1002. Applications 1020 take advantage of the management of resources by operating system 1018 through program modules 1024, and program data 1026, such as the boot/shutdown transaction table and the like, stored either in system memory 1006 or on disk storage 1014. It is to be appreciated that the claimed subject matter can be implemented with various operating systems or combinations of operating systems.

A user enters commands or information into the computer 1002 through input device(s) 1028. Input devices 1028 include, but are not limited to, a pointing device such as a mouse, stylus, touch pad, keyboard, microphone, joystick, game pad, satellite dish, scanner, TV tuner card, digital camera, digital video camera, web camera, and the like. These and other input devices connect to the processing unit 1004 through the system bus 1008 via interface port(s) 1030. Interface port(s) 1030 include, for example, a serial port, a parallel port, a game port, and a universal serial bus (USB). Output device(s) 1036 use some of the same type of ports as input device(s) 1028. Thus, for example, a USB port may be used to provide input to computer 1002 and to output information from computer 1002 to an output device 1036. Output adapter 1034 is provided to illustrate that there are some output devices 1036 like monitors, speakers, and printers, among other output devices 1036, which require special adapters. The output adapters 1034 include, by way of illustration and not limitation, video and sound cards that provide a means of connection between the output device 1036 and the system bus 1008. It should be noted that other devices and/or systems of devices provide both input and output capabilities such as remote computer(s) 1038.

Computer 1002 can operate in a networked environment using logical connections to one or more remote computers, such as remote computer(s) 1038. The remote computer(s) 1038 can be a personal computer, a server, a router, a network PC, a workstation, a microprocessor based appliance, a peer device, a smart phone, a tablet, or other network node, and typically includes many of the elements described relative to computer 1002. For purposes of brevity, only a memory storage device 1040 is illustrated with remote computer(s) 1038. Remote computer(s) 1038 is logically connected to computer 1002 through a network interface 1042 and then connected via communication connection(s) 1044. Network interface 1042 encompasses wire and/or wireless communication networks such as local-area networks (LAN) and wide-area networks (WAN) and cellular networks. LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 1044 refers to the hardware/software employed to connect the network interface 1042 to the bus 1008. While communication connection 1044 is shown for illustrative clarity inside computer 1002, it can also be external to computer 1002. The hardware/software necessary for connection to the network interface 1042 includes, for exemplary purposes only, internal and external technologies such as, modems including regular telephone grade modems, cable modems and DSL modems, ISDN adapters, and wired and wireless Ethernet cards, hubs, and routers.

The illustrated aspects of the disclosure may also be practiced in distributed computing environments where certain tasks are performed by remote processing devices that are linked through a communications network. In a distributed computing environment, program modules can be located in both local and remote memory storage devices.

Moreover, it is to be appreciated that various components described herein can include electrical circuit(s) that can include components and circuitry elements of suitable value in order to implement the embodiments of the subject innovation(s). Furthermore, it can be appreciated that many of the various components can be implemented on one or more integrated circuit (IC) chips. For example, in one embodiment, a set of components can be implemented in a single IC chip. In other embodiments, one or more of respective components are fabricated or implemented on separate IC chips.

What has been described above includes examples of the embodiments of the present invention. It is, of course, not possible to describe every conceivable combination of components or methodologies for purposes of describing the claimed subject matter, but it is to be appreciated that many further combinations and permutations of the subject innovation are possible. Accordingly, the claimed subject matter is intended to embrace all such alterations, modifications, and variations that fall within the spirit and scope of the appended claims. Moreover, the above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize. Moreover, use of the term "an embodiment" or "one embodiment" throughout is not intended to mean the same embodiment unless specifically described as such.

In particular and in regard to the various functions performed by the above described components, devices, circuits, systems and the like, the terms used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter. In this regard, it will also be recognized that the innovation includes a system as well as a computer-readable storage medium having computer-executable instructions for performing the acts and/or events of the various methods of the claimed subject matter.

The aforementioned systems/circuits/modules have been described with respect to interaction between several components/blocks. It can be appreciated that such systems/circuits and components/blocks can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but known by those of skill in the art.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

As used in this application, the terms "component," "module," "system," or the like are generally intended to refer to a computer-related entity, either hardware (e.g., a circuit), a combination of hardware and software, software, or an entity related to an operational machine with one or more specific functionalities. For example, a component may be, but is not limited to being, a process running on a processor (e.g., digital signal processor), a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers. Further, a "device" can come in the form of specially designed hardware; generalized hardware made specialized by the execution of software thereon that enables the hardware to perform specific function; software stored on a computer readable medium; or a combination thereof.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Computing devices typically include a variety of media, which can include computer-readable storage media and/or communications media, in which these two terms are used herein differently from one another as follows. Computer-readable storage media can be any available storage media that can be accessed by the computer, is typically of a non-transitory nature, and can include both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can include, but are not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

On the other hand, communications media typically embody computer-readable instructions, data structures, program modules or other structured or unstructured data in a data signal that can be transitory such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

What is claimed is:

1. An electronic vaporization device, comprising:

a mouthpiece configured to facilitate delivery of a vapor;

a sealed capsule product containing vaping contents the sealed capsule being seal completely surround the vaping contents;

a heating chamber coupled to the mouthpiece, wherein the heating chamber has defined dimensions that are configured to correspond to a size of the sealed capsule product such that the sealed capsule product fits entirely within an interior of the heating chamber;

a heating element configured to vaporize at least a portion of the vaping contents when the sealed capsule is fit within the heating chamber to thereby produce vapor in the heating chamber; and a power source that supplies power to the heating element, wherein the heating chamber is configured to receive the sealed capsule product in response to an opening operation, wherein the sealed capsule product is sealed to completely surround the vaping contents before the sealed capsule product is fit within the interior of the heating chamber, and wherein the heating element is configured to punclure a housing of the sealed capsule product in response to a closing operation.

2. The electronic vaporization device of claim 1, wherein the heating element is coupled to the heating chamber.

3. The electronic vaporization device of claim 1, wherein the heating chamber is configured to receive the heating element and the heating element is configured to be inserted into the heating chamber and removed from the heating chamber.

4. The electronic vaporization device of claim 3, wherein:

the heating chamber is configured to receive the sealed capsule product in response to an opening operation and the heating element is configured to penetrate the sealed capsule product in response to a closing operation.

5. The electronic vaporization device of claim 4, wherein:

the vaping contents are in a liquid state, and the electronic vaporization device further comprises wicking elements, coupled to the heating element, that facilitate wicking of the vaping contents toward the heating element.

6. The electronic vaporization device of claim 4, wherein the heating element is configured to mitigate leaking of the vaping contents from the sealed capsule in response to the closing operation.

7. The electronic vaporization device of claim 1, further comprising a control element that adjustably controls a target temperature of the heating element.

8. The electronic vaporization device of claim 7, wherein the control element comprises a set of discrete temperature settings that map to a corresponding set of vaping contents included in the sealed capsule product.

9. The electronic vaporization device of claim 1, wherein the power source includes:

a housing;

a battery device, included in the housing, configured to power the heating element;

an attachment means, coupled to the housing, configured to detachably attach to the heating chamber; and a temperature control element, operatively coupled to the battery device, that adjustably controls a temperature of the heating element, wherein the heating element is configured to vaporize the vaping contents in response to application of power from the battery device to the heating element, wherein the temperature control element adjustably controls the temperature of the heating element based on:

i) a selecting input made by a user of the power source device using buttons included on the power source device, ii) a signal received from an RFID dot associated with the sealed capsule, or iii) a readable identifier associated with the heating chamber.

10. The electronic vaporization device of claim 9, wherein the temperature control element provides multiple different temperature settings that correspond to multiple different types of vaping contents.

11. The electronic vaporization device of claim 9, wherein the power source determines the temperature of the heating element in response to a determination of a type of heating chamber that is attached to the attachment means.

12. The electronic vaporization device of claim 9, wherein the power source device determines a range of temperatures of the heating element in response to a determination of a type of the vaping contents.

13. The electronic vaporization device of claim 12, wherein the type of the vaping contents includes a liquid type of vaping contents.

14. The electronic vaporization device of claim 9, wherein the attachment means comprises at least one of:

a mated threading, a male or female plug, a slotted clip, or a magnet.

* * * * *